US007232054B2

(12) United States Patent
Yocum

(10) Patent No.: US 7,232,054 B2
(45) Date of Patent: Jun. 19, 2007

(54) CARTON STRUCTURE AND SHEET MATERIAL PRODUCT WITH INDICIA KEYS

(75) Inventor: James A. Yocum, West Chester, PA (US)

(73) Assignee: Dopaco, Inc., Exton, PA (US)

( * ) Notice: Subject to any disclaimer, the term of this patent is extended or adjusted under 35 U.S.C. 154(b) by 50 days.

(21) Appl. No.: 10/274,047

(22) Filed: Oct. 21, 2002

(65) Prior Publication Data

US 2004/0074953 A1 Apr. 22, 2004

(51) Int. Cl.
*B65D 5/42* (2006.01)

(52) U.S. Cl. ..... 229/114; 206/459.5; 206/459.1; 229/116.1; 229/902

(58) Field of Classification Search ..... 229/114, 229/120, 120.15, 116.1, 120.34; 206/459.1, 206/459.5; 40/312
See application file for complete search history.

(56) References Cited

U.S. PATENT DOCUMENTS 3,205,603 A * 9/1965 Brumley ..... 206/459.1
4,472,896 A 9/1984 Brauner et al.
4,784,266 A * 11/1988 Chaussadas ..... 206/434
5,058,803 A 10/1991 Gulliver
5,314,111 A * 5/1994 Takaku et al. ..... 229/110
5,826,781 A * 10/1998 Jensen ..... 229/114
6,041,997 A * 3/2000 Jensen ..... 229/114

OTHER PUBLICATIONS

Packaging Designer, ISBN: 0-8230-6502-2, 1997, p. 66-71.*

* cited by examiner

*Primary Examiner*—Tri M. Mai
(74) *Attorney, Agent, or Firm*—Dennison, Schultz & MacDonald

(57) ABSTRACT

A closable type container for packaging items is constructed of a one piece flat sheet of carton material which is cut and scored to facilitate erection into a box like structure. The closable or clam shell type structure includes an ergonomic toggle action tab having a circular or generally oval shape and a fold line which divides the tab into two tab sections. This ergonomic toggle action tab is movable from a normal position by inward digital pressure on the fold line. Further, radius score lines each have an arc shape which causes a depressed tab section to have a slightly concave surface. An offset fold line between the two tab sections is also disclosed.

13 Claims, 3 Drawing Sheets

CARTON STRUCTURE AND SHEET MATERIAL PRODUCT WITH INDICIA KEYS

FIELD OF THE INVENTION

This invention relates to carton structures and sheet material structures having Improved toggle action keys for indicating the contents of an enclosed item.

BACKGROUND FOR THE INVENTION

Cartons and sheet material products for use in the fast food industry are well-known and may be readily used to package other items. One such style used, but not limited to, is commonly known as a clam shell cartons, which typically include a tray or lower portion and a lid or top portion which is hingedly connected to the lower portion. The cartons are typically formed from a simple paperboard blank which is suitably pre-cut and pre-scored and which when suitably folded and assembled define a container.

In many fast food outlets there is a need for a single container which may be used for a variety of food products. For example, one such container is disclosed in the U.S. Pat. No. 4,472,896 of Brauner et al., which is incorporated herein in its entirety by reference. As disclosed therein, a clam shell carton permits the packager of the food product to indicate on the carton the type of food product contained therein. As disclosed, one panel of the carton carries a plurality of shutter panels, the shutter panels overlapping and normally covering indicia on an indicia panel. Then, with the packaging of a particular food product in the carton, any one of the plurality of shutter panels is swung out in order to expose an appropriate indicia panel.

A more recent approach to a closable carton having indicia indicating tabs is disclosed in the U.S. Pat. No. 5,058,803 of Gulliver. As disclosed therein, a cover structure includes a top wall having a plurality of sidewalls extending therefrom along a straight carton fold line therebetween within a plane defining an interior included angle with a top wall of less than 180° degrees. The cover structure includes a plurality of over center toggle action tabs having indicia associated with each tab. Each over center toggle action tab is defined by cuts and edge lines formed in the top and sidewalls to contain a predetermined length of the common fold line therebetween. The cuts enable the peripheral edge portion of the tab to move toward and away from the adjacent cut top and sidewalls while the peripheral edge portions of the tab defined by the edge lines hinge with respect to the adjacent top and sidewalls. Each over centered toggle action tab is self-retained in a normal position wherein the two tab sections are coplanar with the top and adjacent sidewalls and are movable by inward digital pressure into a self-retained deflected position wherein the interior included angle between the two tab sections is greater than 180° degrees.

It is now believed that there is a significant commercial demand for an improved carton structure and sheet material product having an improved toggle action tab for indicating the contents of an enclosed item. It is believed that there is a demand for a carton and sheet material product that has an annular and preferably circular shaped digital ergonomic toggle action tab in accordance with the present invention. Such tabs fold on a radius score line in the top and one sidewall of a carton. It is also believed that there is a commercial demand for a container or sheet material product wherein the toggle action tabs include an offset fold line which causes the tab to protrude slightly from the top cover or adjacent sidewall of the carton or product in a self-retained position before being deflected inwardly as an indication of the content contained therein.

In addition, the carton and sheet material product in accordance with the present invention can be used for a variety of products and manufactured and sold at a competitive price.

BRIEF SUMMARY OF THE INVENTION

In essence, the present invention contemplates a carton structure for packaging items such as fast foods which may be similar in external appearance but which contain different contents as for example a hamburger with or without various condiments. A preferred form of the invention comprises two adjacent wall portions and a common fold line with the wall portions integrally connected by the common fold line and with an interior included angle of less than 180° degrees. A key feature of this embodiment is a toggle action tab which includes an offset fold line which is displaced from the common fold line for dividing the toggle action tab into two tab sections.

Each of the two wall portions includes tab edge defining means having cuts and an edge line to thereby form the toggle action tab. The two tab sections form an interior included angle of less than 180° but are displaced from the wall portions with one of the tab sections protruding outwardly from one of the wall portions. This toggle action tab is movable from a normal position by inward finger pressure on the offset fold line into a self-retained deflected position wherein the interior angle between the tab section is greater than 180° degrees.

The invention also contemplates a container such as a clam shell or other type container for packaging items having a similar external appearance but different contents. For example, the invention may be used in shirt boxes to indicate color, gift boxes or boxes for wine to indicate type. In the second embodiment of the invention, the container is constructed of a one-piece flat sheet of carton material such as a fibrous paper which is cut and scored to facilitate erection into a box like structure. In the second embodiment, the container includes a first common fold line, a top member and a bottom member hingedly connected along the first common fold line to form a clam like structure.

In a clam like structure, the top member includes a flat top portion, a plurality of top fold lines and a plurality of tab sidewalls integrally connected to the flat top portion by the plurality of top fold lines, and a plurality of connecting tabs for connecting the sidewalls one to another to maintain the top in an open box like structure.

The bottom of the structure includes a flat bottom portion and a plurality of bottom sidewalls i.e., a front, rear and two sidewalls which are integrally connected to the bottom portion by the plurality of common fold lines. The bottom of the structure also includes a plurality of connecting glue tabs for connecting the bottom sidewalls one to another to maintain the bottom in an erect position in the form of an open box like structure.

The second embodiment of the invention also includes an ergonomic toggle action tab with a generally circular or oval shape. It also includes a fold line which is preferably offset from a common fold line between the top member and the front sidewall. This ergonomic toggle action tab is movable from a normal position by inward digital pressure on the fold line in the tab into a self-retained deflected state with an interior angle of greater than 180° degrees. Indicia associated with the deflected tab will then serve as an indicator of the contents.

The structure also includes means such as two pair of latching elements for maintaining the container in a closed position. Other types of closure elements are also contemplated.

The invention also contemplates a third embodiment of the invention which comprises a one-piece carton blank of stiff, resilient and foldable sheet material which is adapted to be folded into a clam shell type container. Such containers are particularly adapted for food products as for example hamburgers and other sandwiches and the like which are sold with or without various condiments. The carton blank includes a plurality of fold lines and a polygonal central lid forming portion having front, rear and side wall closure panels. Each of which is foldably connected by one of the plurality of fold lines to the central lid.

The third embodiment of the invention also includes a polygonal central tray folding portion having front, rear and side wall closure panels which are foldably connected to the central tray. In this embodiment, the rear wall closure panel of the lid is hingedly connected to the rear wall closure panel of the tray by one of the plurality of fold lines to provide a clam shell type structure.

A toggle action tab is formed in a central lid forming portion and in an adjacent one of the front, rear and side wall closure panels, preferably in the front closure panel. The toggle action tab preferably has an offset fold line which is displaced from one of the fold lines which is between the central lid forming portion and the adjacent one of the front, rear and side wall closure panels.

Each of the central lid forming portions and adjacent one of the front rear or side closure panels includes two edge defining means including cuts and an edge line. The cuts and edge line define the toggle action tab.

The invention will now be described in connection with the accompanying drawings wherein like reference numerals have been used to designate like parts.

DESCRIPTION OF THE PREFERRED EMBODIMENTS OF THE INVENTION

Figure 1:
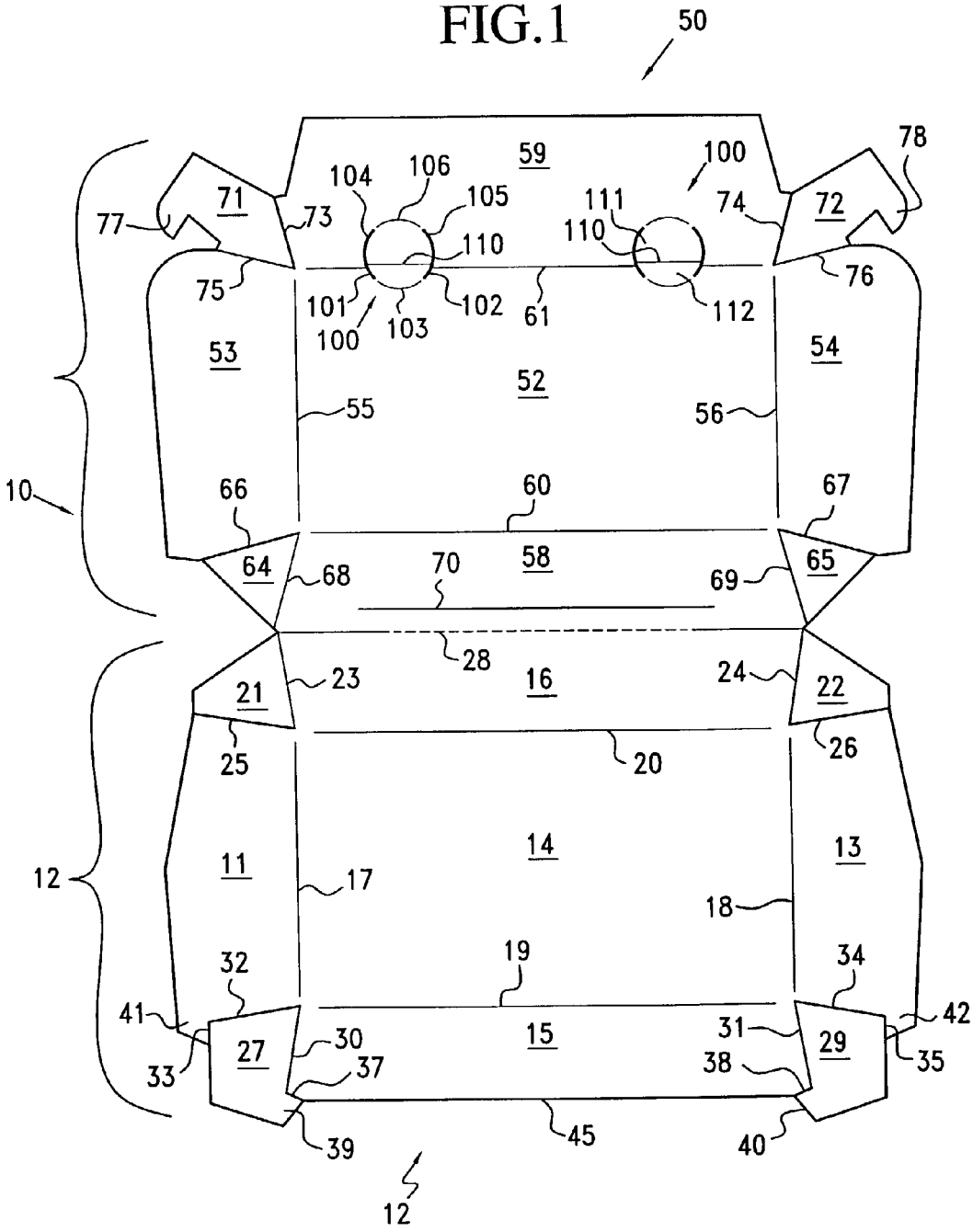
FIG. 1 is a top plan view of a cut and scored flat blank carton material in accordance with a first embodiment of the invention.
Figure 2:
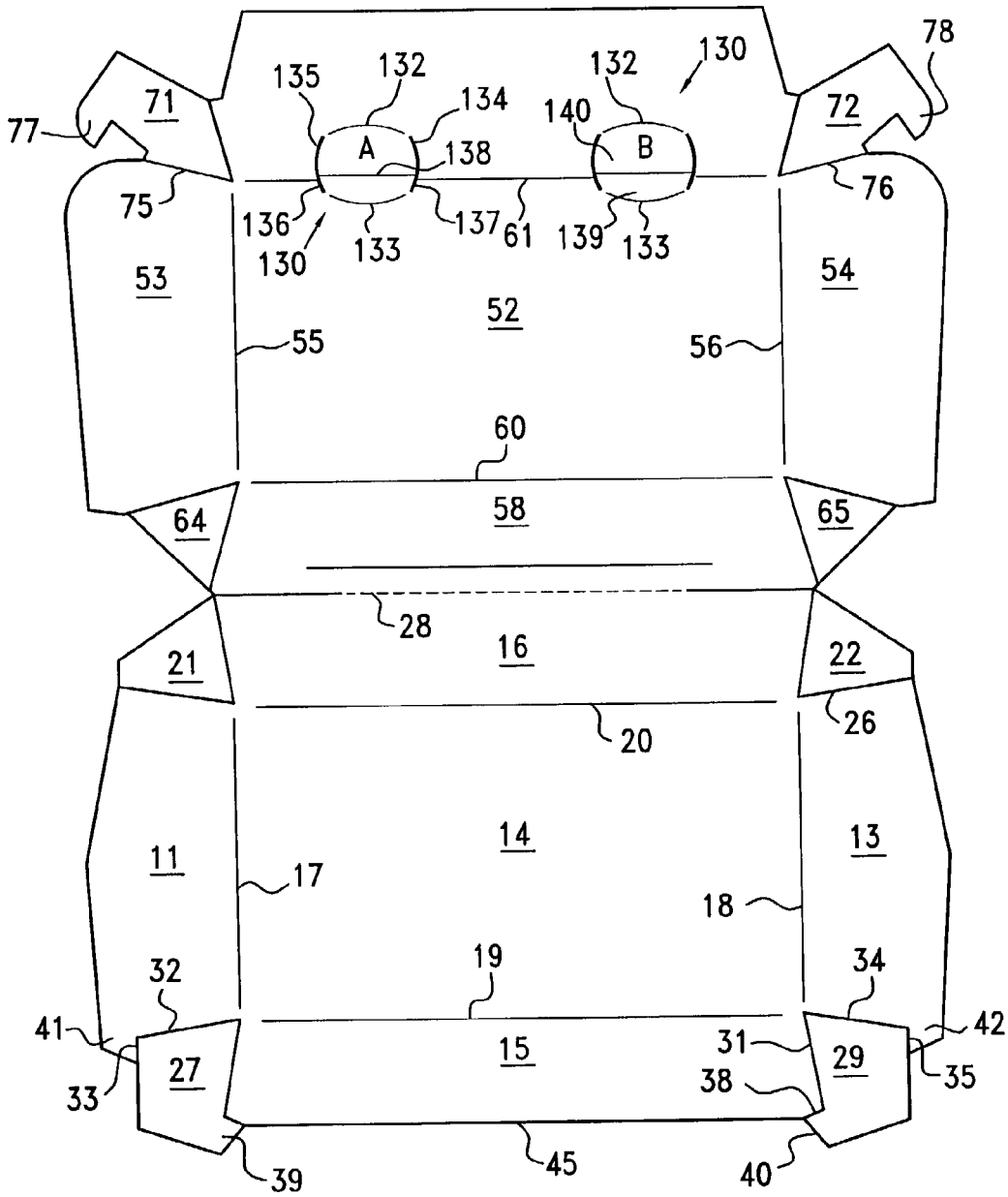
FIG. 2 is a top plan view of a cut and scored flat blank carton material in accordance with a second embodiment of the invention.
Figure 3:
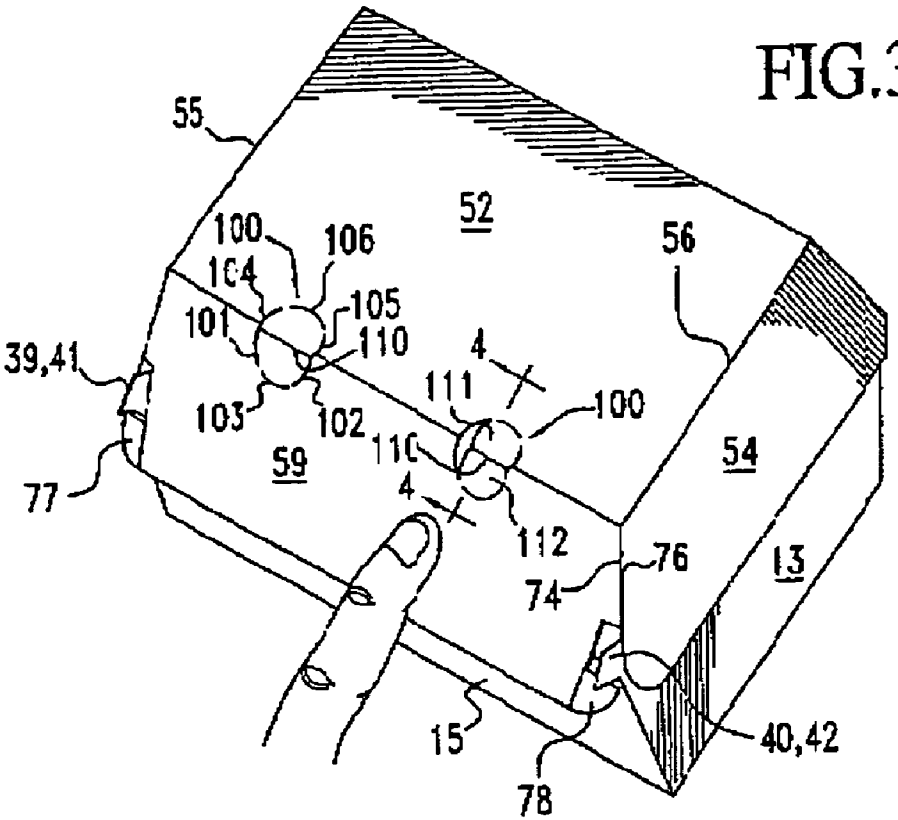
FIG. 3 is a perspective view of a carton erected from the blank shown in FIG. 1.

A carton structure and sheet material product will now be described with reference to FIGS. 1-4. As shown therein, a sheet material product or carton blank 10 as shown more clearly in FIGS. 1 and 2 is formed as a single planar item from a single sheet of foldable material. The preferred materials are paperboard of the type conventionally used in food containers. Such material should be capable of resisting moisture at least to a limited degree, be easily formed into a carton, be relatively inexpensive and in effect incorporate all of the desired attributes of a fast food container. As illustrated the carton blank 10 is operable to be erected and retained by adhesive into an easy open, easy close clam shell type of carton as illustrated in FIG. 3.

As illustrated in FIGS. 1 and 2, the carton blank 10 includes a base or bottom 12 and a top 50. The base or bottom 12 includes a generally flat polygonal tray or bottom portion 14 which is preferably in the shape of a square or rectangle. The base or bottom 12 also includes two opposite bottom side panels or walls 11 and 13, a front bottom panel or wall 15 and a bottom rear panel or wall 16 which are adjacent to and integrally connected to the bottom portion 14 by fold lines 17, 18, 19 and 20.

The bottom rear panel or wall 16 also includes two generally trapezoidal glue flaps 21 and 22 at opposite ends of the bottom rear wall 16 and separated therefrom by fold lines 23 and 24. The glue tabs 21 and 22 are also separated from the bottom side panels or walls 11 and 13 by cuts 25 and 26. The bottom rear panel or wall 16 is also integrally connected to the top 30 by a fold line 28.

A second pair of polygonal shape bottom glue tabs 27 and 29 are integrally connected to the bottom front panel or wall 15 along the fold lines 30 and 31. These glue tabs 27 and 29 are separated from the bottom side panels or walls 11 and 13 by cuts 32, 33, 34 and 35. Cuts 37 and 38 separate a latch portion 39 and a bottom latch portion 40 from the bottom front panel or wall 15. These latch portions 39 and 40 meet with latch portions 41 and 42 in both side walls 11 and 13 to form a double thickness latch member when the carton blank 10 is formed into a clam shell type container. A cut 45 defines a forward upper edge or lip in the bottom front panel 15.

The top 50 includes a top flat polygonal portion 52 which preferably defines a generally square or rectangular shape which is of about the same size and shape as the bottom portion 14. The top 50 also includes a pair of integral top side panels or walls 53 and 54 on opposite sides of the top flat polygonal portion 52 and separated therefrom by fold lines 55 and 56. The top 50 also includes a top rear panel 58 and top front panel 59 which are integrally joined to the top flat polygonal portion 52 along fold lines 60 and 61.

The top side panels or walls 53 and 54 include integrally connected triangular glue tabs 64 and 65 which are separated from the top side panel or walls 53 and 54 by fold lines 66 and 67 and further separated from the top rear panel 58 by cuts 68 and 69. The top rear panel 58 is also integrally connected to the bottom rear panel 16 along the fold line 28 and may include a further cut 70 which prevents the top rear panel 58 from bulging outward as well as providing a vent in the rear of the carton.

Each of the top side panels or walls 53 and 54 include a glue tab 71 and 72 respectively. The glue tabs 71 and 72 are integrally connected to the walls 53 and 54 along the fold lines 75 and 76 and separated from the top front panel 59 by cuts 73 and 74. The glue tabs 71 and 72 each include an upper latch portion 77 and 78 which are constructed and arranged to engage the bottom latch portions 39 and 40 when the glue tabs 71 and 72 are folded over and glued to the top front panel 59. In other words, in a constructed state the bottom fold latch portions 39 and 40 are generally perpendicular or transversed to the upper latch portion 77 and 78 to form a latch assembly which maintains an erected carton in a closed position.

A key feature of the present invention resides in an improved toggle action tab 100 and more particularly to a plurality of such tabs which are preferably disposed in and between a forward part of the top flat polygonal portion 52 and an upper part of the top front panel 59. In a preferred embodiment of the invention the toggle action tabs correspond to a series of indicia "A" and "B" (FIG. 2) to indicate contents as for example, onions, ketchup, mustard, relish and the like. As illustrated each of the tabs 100 is defined by a pair of cuts 101, 102 and fold line 103 in the flat polygonal portion 52 and a pair of cuts 104, 105 and score or fold line 106 in the top front panel 59.

As illustrated the tabs 100 define an ergonomic or rounded shape which is preferably circular. For example, the cuts 101, 102, 103 and 104 as well as the score or fold lines 103 and 106 form a circle. Further a fold line 110 is offset or displaced from the fold line 61. In a preferred embodiment of the invention a circular shape defined by the tabs 100 has a radius of about 0.40625 inches and a score or fold line 110 which is offset from fold line 61 by about 0.025 inches. Further radius score or fold lines 103 and 106 each have an arc shape which causes a depressed tab section to have a slightly concave surface.

The offset fold line 110 causes a portion of the tab 100 to extend outwardly from the top front wall 59 when the carton blank 10 is formed into a carton. As a result of the fold line 110 being offset from fold line 61, the two tab sections 111 and 112 do not lie in the same planes as that of the top front panel or wall 59 or the top polygonal portion 52 when in their normal position in an erected carton.

Figure 4:
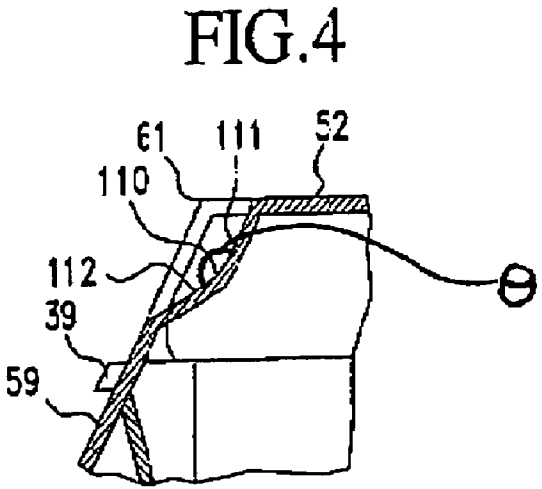
FIG. 4 is sectional view taken along the lines 4-4 in FIG. 3.

Further, the fold line or radius score lines cause the tab sections 111 and 112 to have a slightly concave surface when pressed inward to thereby provide a different feel as shown in FIG. 4.

A second embodiment of the invention is illustrated in FIG. 2. As illustrated therein, the carton blank 10 is configured in the same way as the first embodiment with the exception of the toggle action tabs 130. The tabs 130 define a generally rectangular or square shape with curved edges.

As shown, the tabs 130 have curved scores or fold lines 132 and 133 and cuts 134, 135, 136 and 137 which are arc shaped. An offset fold line 138 is offset from the common fold line 61 and separates the toggle action tab into two tab sections 139 and 140. An assembled clam shell type carton is shown in FIG. 3.

The erected carton as shown in FIG. 3 is formed into a clam shell type container. For example, the base or bottom 12 is formed and maintained in an open boxlike structure by gluing the glue tabs 21 and 22 and 27 and 29 to the sidewalls 11 and 13. In a similar manner the top 50 is formed into an open boxlike structure by gluing the glue tabs 64 and 65 to the sidewalls 53 and 54 and the glue tabs 71 and 72 to the front panel 59.

While the invention has been defined in connection with its preferred embodiments, it should be recognized that changes and modifications can be made therein without departing from the scope of the appended claims.

What is claimed is:

1. In a carton structure for packaging items having a similar external appearance but different contents, the improvement comprising:

two wall portions and a common fold line with said two wall portions integrally connected by said common fold line with an interior included angle of less than 180° degrees;

an indicia key including at least an arc-shaped fold line, at least a cut line, and a slightly offset fold line which is minimally displaced from said common fold line for dividing said indicia key into two tab sections, and wherein said at least a cut line extends from a portion of one of said two wall portions to a portion of the other one of said two wall portions and intersects said common fold line;

each of said two wall portions including tab edge defining means formed in each of said wall portions to thereby form said indicia key with said tab sections forming an interior included angle of less than 180° degrees but angularly displaced from said wall portions with one of said tab sections protruding outwardly from one of said wall portions; and said indicia key being movable from a normal position by inward digital pressure on said offset fold line into a self-retained deflected position wherein the interior angle between said tab section is greater than 180° degrees.

2. A carton structure for packaging items having a similar external appearance but different contents as defined in claim 1 wherein said offset fold line and said common fold line are parallel.

3. A carton structure for packaging items having a similar external appearance but different contents as defined in claim 1 wherein said indicia key has an ergonomic shape.

4. A carton structure for packaging items having a similar external appearance but different contents as defined in claim 1 wherein said indicia key has a circular shape.

5. A carton structure for packaging items having a similar external appearance but different contents as defined in claim 1 wherein said structure includes a plurality of indicia keys.

6. A clam shell type container for packaging items having a similar external appearance but different contents, said container comprising:

a one-piece flat sheet of carton material cut and scored to facilitate erection into a box-like structure;

said clam shell type container including a first common fold line, a top and a bottom hingedly connected along said first common fold line to form a clam shell type structure;

said top including a flat top portion, a plurality of top fold lines and a plurality of top side walls integrally connected to said flat top portion by said plurality of top fold lines and a plurality of connecting tabs connecting said plurality of top side walls one to another to maintain the top in an open box-like structure;

said bottom including a flat bottom portion, a plurality of bottom fold lines and a plurality of bottom side walls integrally connected to said bottom portion by said plurality of bottom fold lines, and a plurality of tabs connecting said plurality of bottom side walls one to another to maintain the bottom in an erect position in the form of an open box-like structure;

an ergonomic indicia key extending into said flat top portion and one of said top side walls and an offset fold line dividing said ergonomic indicia key into two tab sections;

said flat top portion and one of said top side walls each including cuts and a curved score line to thereby form said indicia key with said two tab sections forming an interior included angle of less than 180° degrees;

said ergonomic indicia key being movable from a normal position by inward finger pressure on said fold line of said indicia key into a self-retained deflected interior angle of greater than 180° degrees; and, means for maintaining said top and bottom of said carton in a closed position.

7. A clam shell type container for packaging items having a similar external appearance but different contents according to claim 6, in which said ergonomic indicia key defines a circular shape.

8. A clam shell type container for packaging items having a similar external appearance but different contents according to claim 6 in which said plurality of connecting tabs in said top and said bottom are glued to an adjacent wall.

9. A clam shell type container for packaging items having a similar external appearance but different contents according to claim 8 in which each of said cuts in said top portion and said top side wall portion are curved whereby said tab folds with respect to said top portion on a radius score line.

10. A clam shell type container for packaging items having a similar external appearance but different contents according to claim 6 which includes a plurality of ergonomic indicia keys.

11. A clam shell type container for packaging items having a similar external appearance but different contents according to claim 10 which includes indicia corresponding to each of said ergonomic indicia keys.

12. A carton structure for packaging items having a similar external appearance but different contents, the improvement comprising:

two wall portions and a common fold line with said two wall portions integrally connected by said common fold line with an interior included angle of less than 180°;

an ergonomic indicia key including at least an arc-shaped fold line and a slightly offset fold line which is minimally displaced from said common fold line for dividing said indicia key into two sections, and wherein at least a cut line extends from a portion of one of said two wall portions to a portion of the other one of said two wall portions and intersects said common fold line;

each of said two wall portions including tab end defining means including cuts and an edge line formed in each of said wall portions to thereby form said indicia key with said tab sections forming an interior included angle of less than 180°;

said indicia key being movable from a normal position by inward digital pressure on said offset fold line into a self-retained deflected position wherein the interior angle between said tab section is greater than 180°.

13. A carton structure for packaging items having a similar external appearance but different contents as defined in claim 12 wherein said indicia key has a circular shape.

* * * * *